US009072422B2

(12) United States Patent
Kozinski et al.

(10) Patent No.: US 9,072,422 B2
(45) Date of Patent: Jul. 7, 2015

(54) DISHWASHER APPLIANCE WITH A DETACHABLE DOOR

(75) Inventors: Kyle A. Kozinski, Louisville, KY (US); Alan Lucas, Mount Washington, KY (US); Bradley Nicholas Gilkey, Louisville, KY (US)

(73) Assignee: General Electric Company, Schenectady, NY (US)

( * ) Notice: Subject to any disclaimer, the term of this patent is extended or adjusted under 35 U.S.C. 154(b) by 830 days.

(21) Appl. No.: 13/360,944

(22) Filed: Jan. 30, 2012

(65) Prior Publication Data

US 2013/0193819 A1 Aug. 1, 2013

(51) Int. Cl.
*A47L 15/42* (2006.01)

(52) U.S. Cl.
CPC ..... *A47L 15/4261* (2013.01)

(58) Field of Classification Search
None
See application file for complete search history.

(56) References Cited

U.S. PATENT DOCUMENTS

| | | | |
|---|---|---|---|
| 2,842,117 | A | 7/1958 | Berge |
| 3,067,736 | A | 12/1962 | Barefoot |
| 3,327,701 | A | 6/1967 | Smith |
| 2011/0095014 | A1 | 4/2011 | Choi |

FOREIGN PATENT DOCUMENTS

| | | | |
|---|---|---|---|
| EP | 1443846 | B1 | 4/2005 |

*Primary Examiner* — Jason Ko
(74) *Attorney, Agent, or Firm* — Dority & Manning, P.A.

(57) ABSTRACT

The present disclosure relates to consumer appliance having a door that may be selectively detached from a cabinet of the appliance. More specifically, the door can be detached by sliding a hinge out of a bracket. To attach the door, the hinge is inserted into the bracket.

18 Claims, 5 Drawing Sheets

FIG. –1–

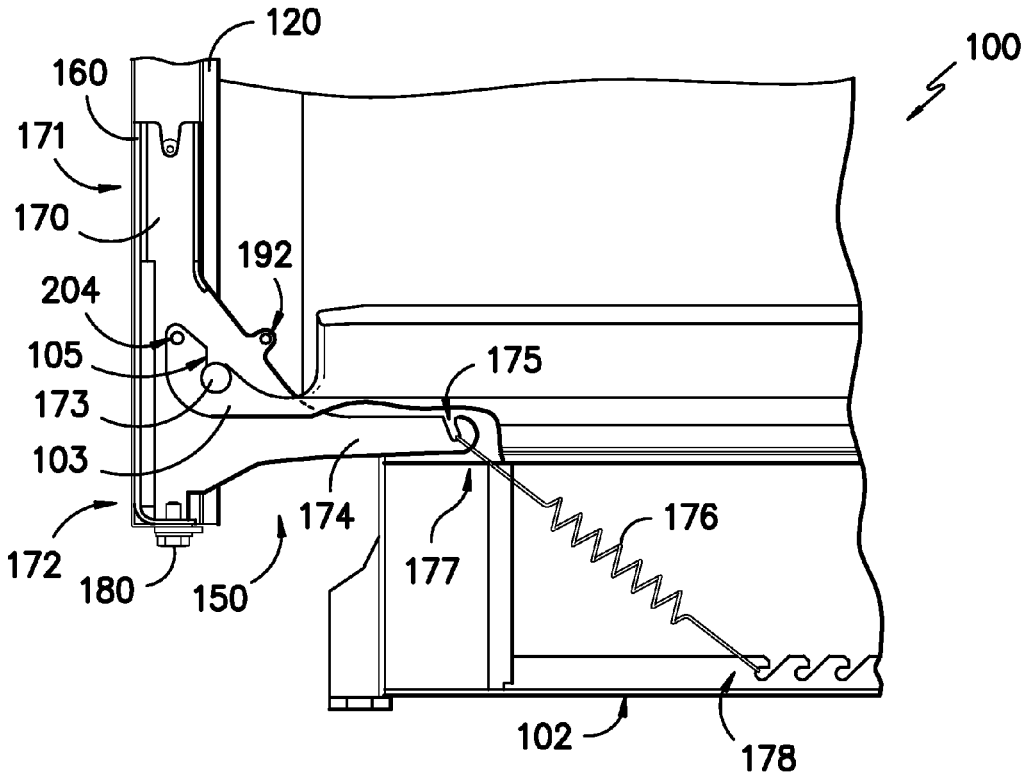
FIG. –3–
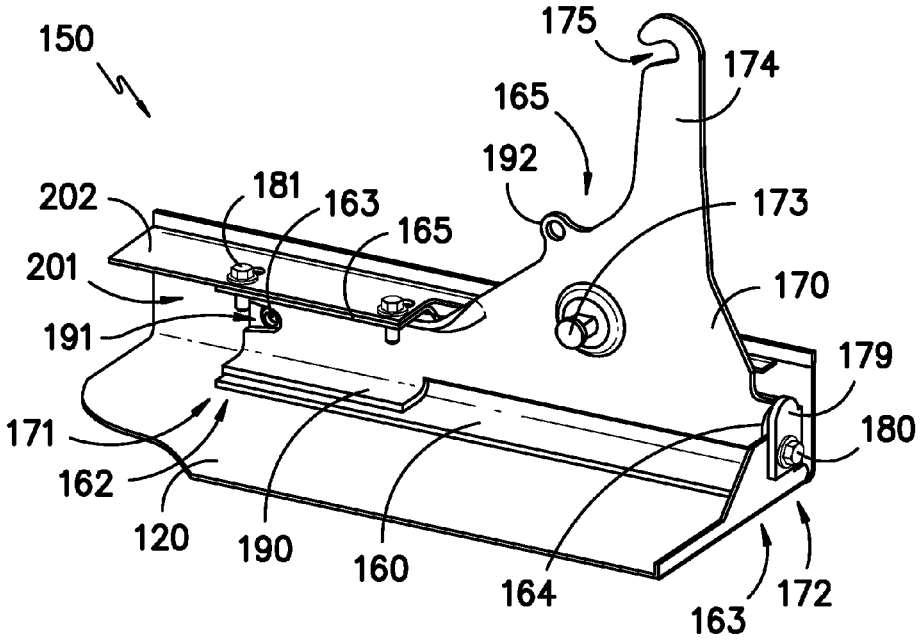
FIG. –4–

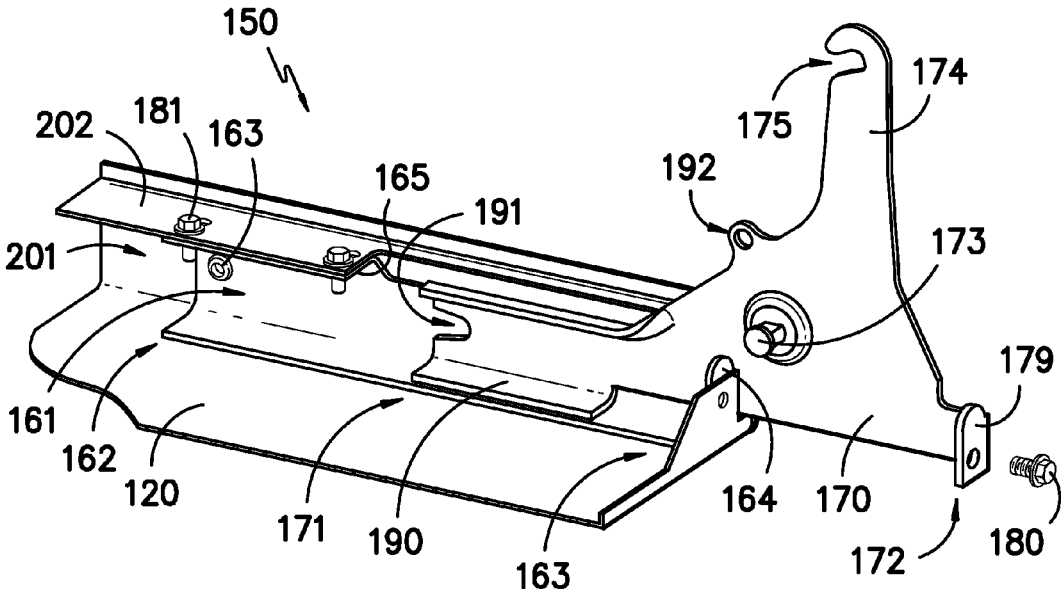
FIG. –5–
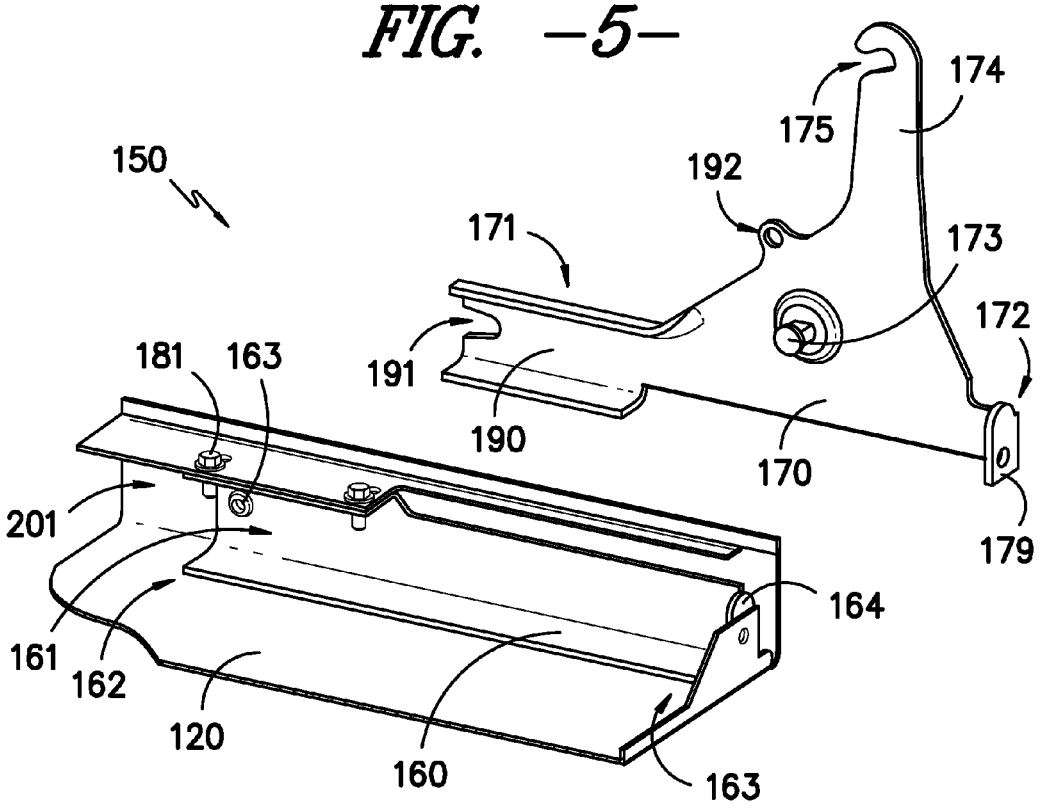
FIG. –6–

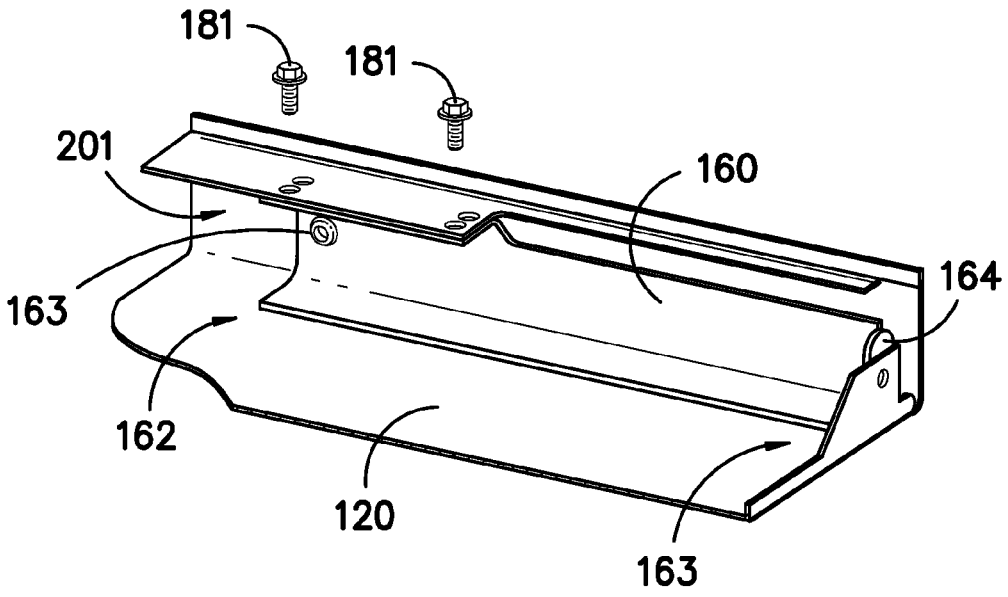
FIG. —7—
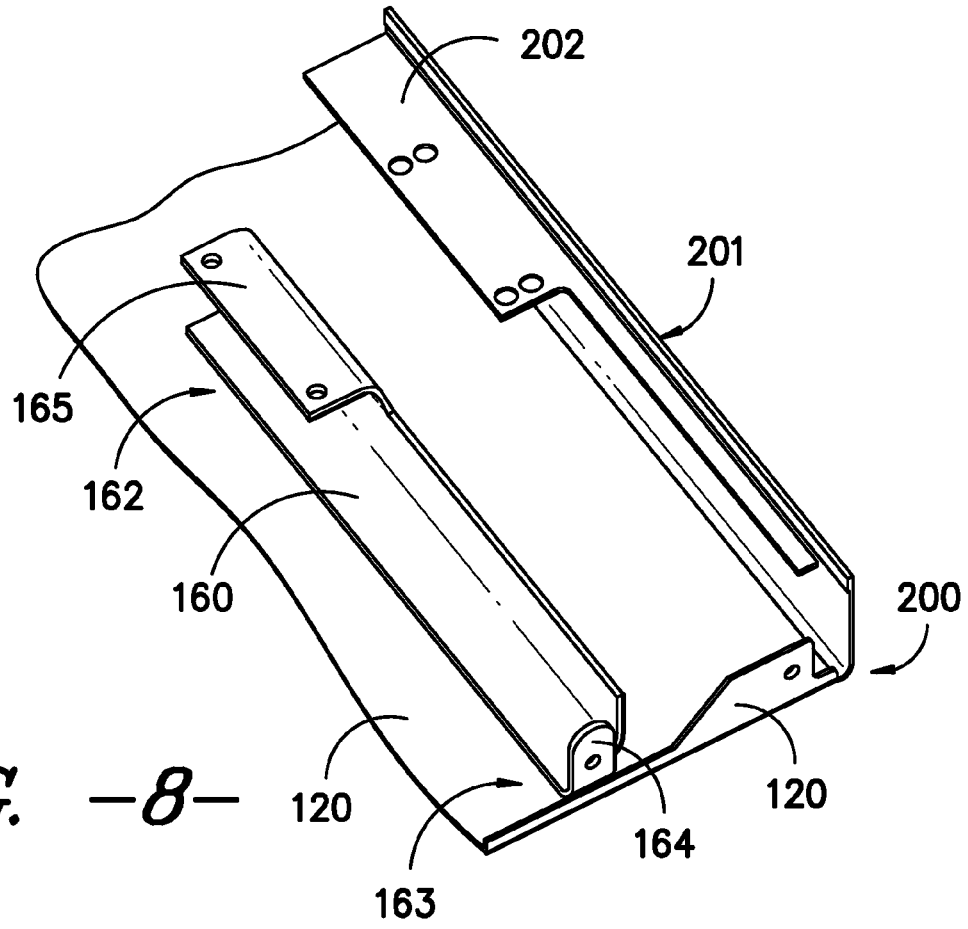
FIG. —8—

DISHWASHER APPLIANCE WITH A DETACHABLE DOOR

FIELD OF THE INVENTION

The subject matter disclosed herein relates generally to a dishwasher appliance with a detachable door.

BACKGROUND OF THE INVENTION

Conventional dishwasher appliances typically include a cabinet that defines a washing chamber for receiving items for washing. A door mounted to the cabinet provides selective access to the washing chamber. The door is normally mounted to the cabinet using hinges that allow the door to rotate between an open configuration and a closed configuration. To assist a user in opening and closing the door, the hinge can be coupled to tension springs. The tension springs are configured so that the amount of force a user needs to apply to the door in order to adjust the door between the open and closed configurations is reduced.

When servicing a dishwasher appliance, a technician may need to remove the door of the dishwasher appliance. In certain current dishwasher designs, the hinges that couple the door to the cabinet cannot be easily accessed by the technician in order to remove the door from the cabinet. Thus, the technician must slide the dishwasher appliance out of a countertop enclosure that houses the dishwasher appliance in order to access the hinges and remove the door. However, removing the dishwasher appliance from its enclosure may be a time consuming process because the appliance's electrical and plumbing connections must normally be severed in order to move the appliance.

In addition, removing the appliance from its enclosure may also damage an appliance owner's flooring as the appliance slides across the flooring. Also, the technician must normally decouple the hinge from the door's tension springs in order to remove the door from the cabinet. Decoupling the tension springs from the hinges can be another time consuming process.

Accordingly, new hinge designs are needed that can allow for quick removal of a door of a dishwasher appliance without having to remove the appliance from the appliance's enclosure. Such a hinge design that can also allow for removal of the door without having to decouple the door's hinges from the door's tension springs is also needed.

BRIEF DESCRIPTION OF THE INVENTION

Aspects and advantages of the invention will be set forth in part in the following description, or may be obvious from the description, or may be learned through practice of the invention.

In a first embodiment, the present subject matter discloses an appliance. The appliance has a cabinet defining a chamber. The appliance also has a door removably mounted to the cabinet. The door provides selective access to the chamber of the cabinet. The door also defines a pocket at a corner of the door. In addition, the door also defines a flange located adjacent the pocket. The appliance further includes a bracket configured for receipt into the pocket of the door. The bracket has a first end defining a channel with a c-shaped profile. The first end of the bracket also defines a projection for mating receipt of the flange of the door. The bracket also has a second end spaced apart longitudinally from the first end of the bracket. The second end of the bracket defines a tab. The tab is disposed orthogonal to the flange of the door. In addition, the appliance has a hinge positioned at the pocket of the door. The hinge has a first end positioned inside the channel of the bracket. The hinge also has a second end spaced apart longitudinally from the first end of the hinge. The second end of the hinge defines an extension. The extension is disposed orthogonal to the flange of the door. The extension also is positioned adjacent the tab of the bracket. The appliance further includes a fastener positioned adjacent the tab of the bracket and the extension of the hinge. The fastener selectively couples the tab and the extension together.

In a second embodiment, the present subject matter discloses a consumer appliance. The consumer appliance has a cabinet defining a chamber. A door is removably mounted to the cabinet. The door provides selective access to the chamber of the cabinet. A bracket is mounted to the door. The bracket extends longitudinally from a first end to a second end. The bracket has a channel located at the first end of the bracket. A tab is located at the second end of the bracket. The consumer appliance also has a hinge rotatably mounted to the cabinet. The hinge extends longitudinally from a first end to a second end. The hinge has a leg located adjacent the first end of the hinge. The leg is configured for sliding within the channel of the bracket such that at least a portion of the bracket is disposed between the hinge and the door. The hinge also has an extension located adjacent the second end of the hinge. A fastener selectively couples the tab of the bracket and the extension of the hinge together.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 3 provides a cross-sectional view of an exemplary hinge assembly coupling a door of the dishwasher appliance of FIG. 1 to the cabinet of the dishwasher appliance;

FIGS. 4-8 illustrate perspective views of a door, a bracket, and a hinge according to an exemplary embodiment of the present subject matter, the components are shown in various states of attachment.

DETAILED DESCRIPTION OF THE INVENTION

Figure 1:
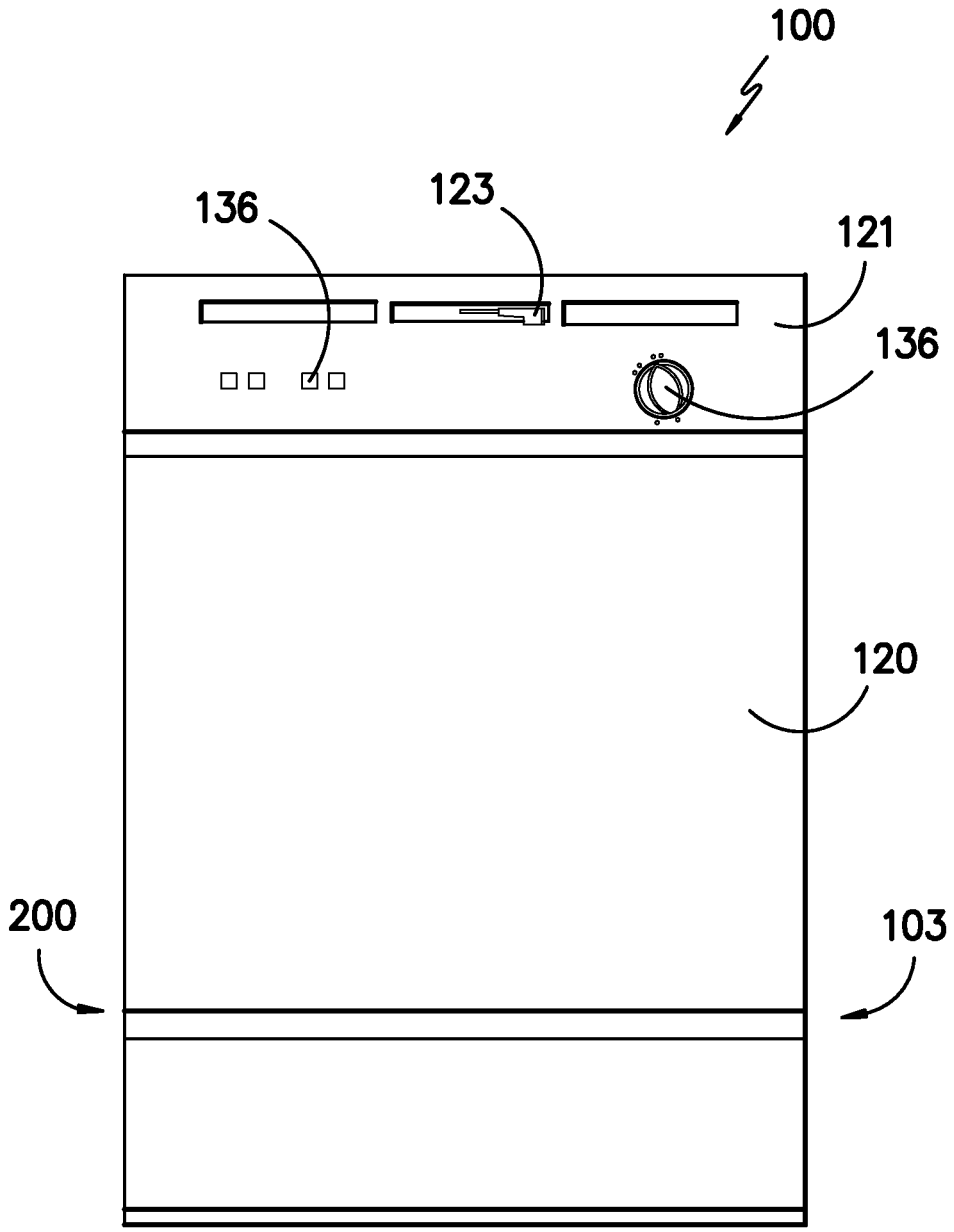
FIG. 1 provides a front view of an dishwasher appliance according to an exemplary embodiment of the present subject matter.

The present disclosure relates to consumer appliance having a door that may be selectively detached from a cabinet of the appliance. More specifically, the door can be detached by sliding a hinge out of a bracket. To attach the door, the hinge is inserted into the bracket. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 depicts an exemplary domestic dishwasher 100 that may be configured in accordance with aspects of the present disclosure. For the particular embodiment of FIG. 1, the dishwasher 100 includes a cabinet 102 having a tub 104 therein that defines a wash chamber 106. The tub 104 includes a door 120 hinged at its bottom 122 for movement between a normally closed configuration (shown in FIGS. 1 and 2), wherein the wash chamber 106 is sealed shut (e.g., for washing operation), and an open configuration (e.g., for loading and unloading of articles from the dishwasher). A latch 123 is used to lock and unlock the door 120 for access to the chamber 106.

Upper and lower guide rails 124, 126 are mounted on tub side walls 128 and accommodate upper and lower roller-equipped rack assemblies 130, 132, respectively. Each of the upper and lower racks 130, 132 is fabricated into lattice structures including a plurality of elongated members 134. Each rack 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by rollers 135 and 139, for example, mounted onto racks 130 and 132, respectively. A silverware basket (not shown) may be removably attached to the lower rack 132 for placement of silverware, utensils, and the like, that are too small to be accommodated by the upper and lower racks 130, 132.

The dishwasher 100 further includes a lower spray-arm assembly 144 that is rotatably mounted within a lower region 146 of the wash chamber 106 and above a tub sump portion 142 so as to rotate in relatively close proximity to the lower rack 132. A mid-level spray-arm assembly 148 is located in an upper region of the wash chamber 106 and may be located in close proximity to upper rack 130. Additionally, an upper spray arm assembly (not shown) may be located above the upper rack 130.

The lower and mid-level spray-arm assemblies 144, 148 and the upper spray arm assembly are fed by a fluid circulation assembly for circulating water and dishwasher fluid in the tub 104. The fluid circulation assembly may be located in a machinery compartment 140 located below the bottom sump portion 142 of the tub 104, as generally recognized in the art. Each spray-arm assembly includes an arrangement of discharge ports or orifices for directing washing liquid onto dishes or other articles located in the upper and lower racks 130, 132, respectively. The arrangement of the discharge ports in at least the lower spray-arm assembly 144 provides a rotational force by virtue of washing fluid flowing through the discharge ports. The resultant rotation of the lower spray-arm assembly 144 provides coverage of dishes and other dishwasher contents with a washing spray.

The dishwasher 100 is further equipped with a controller 137 to regulate operation of the dishwasher 100. The controller may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher 100. In the illustrated embodiment, the controller 137 may be located within a control panel area 121 of door 120 as shown. In such an embodiment, input/output ("I/O") signals may be routed between the control system and various operational components of dishwasher 100 along wiring harnesses that may be routed through the bottom 122 of door 120. Typically, the controller 137 includes a user interface panel 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electromechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

Figure 2:
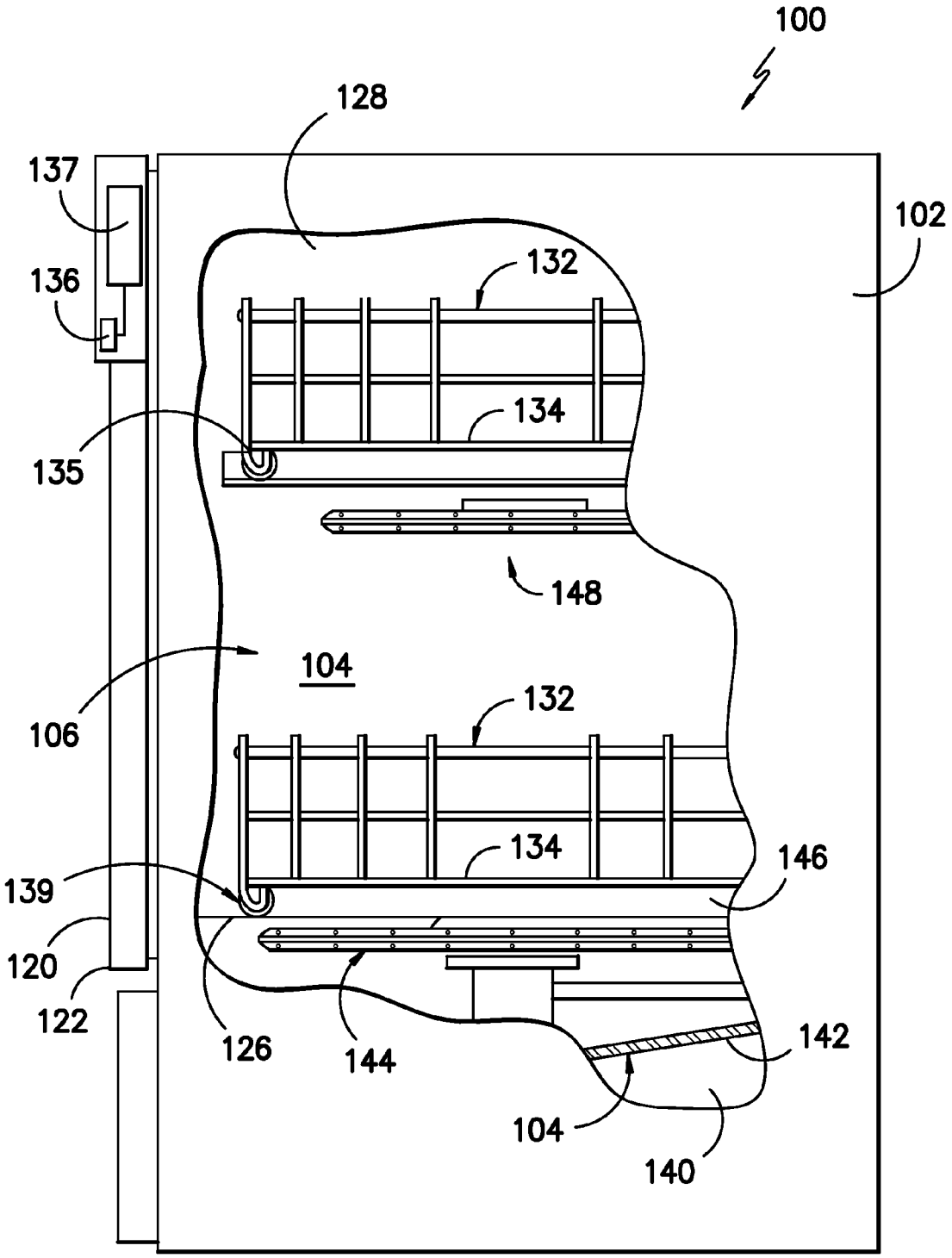
FIG. 2 provides a side view of the dishwasher appliance of FIG. 1 with a portion of the cabinet is removed to reveal the interior of the dishwasher appliance.

It should be appreciated that the invention is not limited to any particular style, model, or other configuration of dishwasher or appliance in general, and that the embodiment depicted in FIGS. 1 and 2 is for illustrative purposes only. For example, the present subject matter may be used in any suitable appliance, such as an oven, a microwave, an ice maker, a refrigerator, a dryer, or a washing machine.

FIG. 3 provides a cross-sectional view of the dishwasher appliance 100 of FIG. 1 with a hinge assembly 150 coupling the door 120 to the cabinet 102. Portions of the dishwasher appliance 100 have been removed to reveal the hinge assembly 150. As discussed above, the door 120 is rotatably coupled to the cabinet 102. To couple the door 120 to the cabinet 102, the hinge assembly 150 has a bracket 160, a hinge 170, and a fastener 180.

Referring now to both FIGS. 3 and 4, the bracket 160 is mounted to the door 120. The hinge 170 is rotatably coupled to the cabinet 102. The hinge 170 extends between a first end 171 and a second end 172. A pin 173 is positioned on the hinge 170 between the first end 171 and the second end 172. To couple the hinge 170 to the cabinet 102, the pin 173 is rotatably received into a slot 105 defined by a connection element 103 of the cabinet 102. The connection element 103 is positioned at the bottom 203 (shown in FIG. 1) of the cabinet 102. The pin 173 acts as a point of rotation for the door 120 as the door 120 shifts between a closed configuration and an open configuration. The hinge 170 is also coupled to the bracket 160. As will be discussed in more detail below, the first end 171 of the hinge 170 is received by the bracket 160, and the fastener 180 couples the bracket 160 and the second end 172 of the hinge 170 together.

Hinge 170 also defines an arm 174. Further, the arm 174 defines an indention 175. The indention 175 receives a first end 177 of a spring 176. A second end 178 of the spring 176 is received by the cabinet 102 such that the spring 176 extends between the arm 174 and the cabinet 102. The spring 176 assists shifting the door 120 between the open and closed configurations.

The hinge 170 also defines a locking hole 192. The locking hole 192 is positioned between the first and second ends 171,172 of the hinge. In order to orient the door for detachment, the locking hole 192 may be aligned with an alignment hole 204 defined by the connection element 103. A lock (not shown), such as for example, a zip-tie, rod, or any other suitable lock, may be inserted through the locking hole 192 and the aligning hole 204 in order to, e.g., fixedly position the hinge 170 for detachment of the door 120 from the cabinet 102 and subsequent reattachment of the door 120 to the cabinet 102.

FIGS. 4-8 illustrate perspective views of the hinge assembly 150 and a portion of the door 120 in various steps of detaching the hinge assembly 150 from the door 120. When the bracket 160 of the hinge assembly 150 is attached to the door 120, the bracket 160 is disposed within a pocket 201 defined by the door 120 adjacent a corner 200 (FIG. 1) of the door 120. Thus, the pocket 201 is configured for mating receipt of the bracket 160.

In addition, the bracket 160 also defines a projection 165. In FIG. 4, the projection 165 is positioned adjacent a flange 202 defined by the door 120. The flange 202 is positioned adjacent to the pocket 201 of the door 120. The projection 165 and the flange 202 may be coupled together with additional fasteners 181.

The bracket 160 extends between a first end 162 and a second end 163. Thus, the first and second ends 162,163 of the bracket 160 are longitudinally spaced apart. The bracket 160 defines a channel 161 positioned adjacent the first end 162 of the bracket 160. The first end 161 of the bracket 161 also defines a stop 163. The stop 163 extends into the channel 161 of the bracket 160. The bracket 160 further includes a tab 164 positioned adjacent the second end 162 of the bracket 160. In FIG. 4, the tab 164 is disposed orthogonally to the flange 202 of the door 120.

Also, as discussed above, the hinge 170 extends between the first end 171 of the hinge 170 and the second end 172 of the hinge 170. Thus, the first and second ends 171,172 of the hinge 170 are longitudinally spaced apart. The hinge has a leg 190 positioned adjacent the first end 171 of the hinge 170. The hinge 170 also has an extension 179 positioned adjacent the second end 172 of the hinge 170. In FIG. 4, the extension 179 is orthogonal to the flange 202 of the door 120.

In FIGS. 4-8, the channel 161 of the bracket 160 has a c-shaped profile. The c-shaped profile of the channel 161 is configured for receipt of the leg 190 of the hinge 170. Thus, in FIG. 4, the leg 190 has a c-shaped profile and is disposed within the channel 161 such that at least a portion of the bracket 160 is disposed between the hinge 170 and the door 120. In alternative embodiments, the channel 161 and leg 190 may have any suitable profile that allows a leg 190 of the hinge to slide within the channel 161 defined by the bracket 160.

The extension 179 and the tab 164 are configured to be selectively coupled with the fastener 180. As shown in FIG. 4, the extension 179 is positioned adjacent the tab 164. The fastener 180 extends through the extension 179, tab 164, and the door 120 in order to assist in hindering the leg 190 from sliding within the channel 161 of the bracket 160.

In FIG. 4, the tab 164 and the extension 179 are positioned adjacent the bottom 122 (shown in FIG. 3) of the door 120. In turn, the fastener 180 is also positioned adjacent the bottom 122 of the door 120. Because the fastener is positioned adjacent the bottom 122 of the door 120, a technician may easily access the fastener 180 in order to couple or decouple the tab 164 and extension 179. In addition, as shown in FIG. 5, the fastener 180 may be removed from the hinge assembly 150. By removing the fastener 180, the leg 190 of the hinge is free to slide within the channel 161 of the bracket 160 and thus allow the door 120 to be removed from the cabinet 102 (shown in FIG. 3). Thus, the technician may remove the fastener 180, and, as shown in FIGS. 5 and 6, slide the leg 190 out of the channel 161 in order to detach the door 120 from the cabinet 102.

The first end 171 of the hinge 170 also defines a notch 191. The notch 191 is configured for receipt of the stop 163 of the bracket 160. Thus, as shown in FIG. 4, the stop 163 may be positioned within the notch 191. By disposing the stop 163 within the notch 191, the stop 163 may assist in hindering the leg 190 from sliding within the channel 161. Thus, the notch 191 assists in positioning the leg 190 in the channel 161 by preventing the leg 161 from sliding past the stop 163.

As may be seen in FIGS. 7 and 8, the bracket 160 may slide into the pocket 201 defined by the door 120. As discussed above, the flange 202 of the door may be positioned adjacent the projection 165 of the bracket 160. Also, as discussed above, the bracket 160 is mounted to the door 120 with the pair of additional fasteners 181. As may be seen in FIGS. 7 and 8, the additional fasteners 181 extend through the flange 202 of the door 120 and the projection 165 of the bracket 160. The additional fasteners 181 may also assist in hindering the leg 190 from sliding within the channel 161.

As discussed above, to remove door 120 for servicing the technician may remove the fastener 180, and, as shown in FIGS. 5 and 6, slide the leg 190 out of the channel 161 in order to detach the door 120 from the cabinet 102. At the end of the service call, the service technician may slide the leg 190 into the channel 161 in order to reattach the door 120. When the tab 164 and extension 179 are positioned adjacent to one another, the service technician may replace the fastener 180 to prevent the leg 190 from sliding in the channel 161 and secure the door 120 to the cabinet 102. Thus, the hinge assembly 150 provides for quick detaching of the door 120 without having to decouple the hinge assembly 150 from the spring 176 and without having to remove the cabinet 102 from a countertop enclosure housing the dishwasher appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance comprising:

a cabinet defining a chamber;

a door removably mounted to said cabinet, said door providing selective access to the chamber of said cabinet, said door defining a pocket at a corner of said door, said door also defining a flange located adjacent the pocket;

a bracket configured for receipt into the pocket of said door, said bracket having a first end defining a channel with a c-shaped profile, the first end of said bracket also defining a projection for mating receipt of the flange of said door, said bracket also having a second end spaced apart longitudinally from the first end of said bracket, the second end of said bracket defining a tab, the tab being disposed orthogonal to the flange of said door;

a hinge positioned at the pocket of said door, said hinge having a first end positioned inside the channel of said bracket, said hinge also having a second end spaced apart longitudinally from the first end of said hinge, the second end of said hinge defining an extension, the extension being disposed orthogonal to the flange of said door, the extension also being positioned adjacent the tab of said bracket; and a fastener positioned adjacent the tab of said bracket and the extension of said hinge, the fastener selectively coupling the tab and the extension together.

2. The appliance of claim 1, wherein said hinge further defines an arm projecting out of the pocket and away from the second end of the hinge.

3. The appliance of claim 2, wherein a distal end of the arm of said hinge defines an indentation, and a spring extends between the indention of the arm and said cabinet.

4. The appliance of claim 1, further comprising:

a connection element positioned near a bottom portion of said appliance and defining a slot; and a pin positioned on said hinge between the first end of said hinge and the second end of said hinge, said pin rotatably received into the slot of said connection element.

5. The appliance of claim 1, wherein said bracket includes a stop positioned in the channel of said bracket, the stop also positioned adjacent the first end of said hinge.

6. The appliance of claim 5, wherein the first end of said hinge defines a notch, and the stop of said bracket is disposed in the notch.

7. The appliance of claim 1, wherein the tab of said bracket and the extension of said hinge are positioned adjacent a bottom edge of said door.

8. The appliance of claim 1, further comprising an additional fastener, the additional fastener extending through the flange of said door and the projection of said bracket.

9. The appliance of claim 1, wherein the appliance is a dishwasher appliance.

10. A consumer appliance comprising:

a cabinet defining a chamber;

a door removably mounted to said cabinet, said door providing selective access to the chamber of said cabinet;

a bracket mounted to said door, said bracket extending longitudinally from a first end to a second end, said bracket having a channel located at the first end of said bracket and a tab located at the second end of said bracket;

a hinge rotatably mounted to said cabinet, said hinge extending longitudinally from a first end to a second end, said hinge having a leg located adjacent the first end of said hinge, the leg configured for sliding within the channel of said bracket such that at least a portion of said bracket is disposed between said hinge and said door, the hinge also having an extension located adjacent the second end of said hinge; and a fastener selectively coupling the tab of said bracket and the extension of said hinge together.

11. The consumer appliance of claim 10, wherein said bracket includes a stop located adjacent the first end of said bracket, the stop also positioned adjacent the leg of said hinge.

12. The consumer appliance of claim 11, wherein the leg of said hinge defines a notch at the end of the leg, and the stop of said bracket is at least partially disposed in the notch.

13. The consumer appliance of claim 10, wherein the extension of said hinge and the tab of said bracket are positioned adjacent a bottom edge of said door.

14. The consumer appliance of claim 10, wherein the channel of said bracket defines a c-shaped profile.

15. The consumer appliance of claim 14, wherein the leg of said hinge defines a c-shaped profile.

16. The consumer appliance of claim 10, wherein said fastener extends through said door, said hinge, and said bracket.

17. The consumer appliance of claim 10, further comprising an additional fastener, said bracket being mounted to said door with the additional fastener at the first end of the bracket, the additional fastener extending through said door and said bracket.

18. The consumer appliance of claim 10, wherein the consumer appliance is a dishwasher appliance.

* * * * *